US009924260B2

(12) United States Patent
Petersén

(10) Patent No.: US 9,924,260 B2
(45) **Date of Patent: *Mar. 20, 2018**

(54) AUDIO ACCESSORY INCLUDING A HEADPHONE WITH SEPARATE SOCKETS

(71) Applicant: Zound Industries International AB, Stockholm (SE)

(72) Inventor: Erik Petersén, Nacka (SE)

(73) Assignee: Zound Industries International AB, Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/240,401

(22) Filed: Aug. 18, 2016

(65) Prior Publication Data

US 2016/0360309 A1 Dec. 8, 2016

Related U.S. Application Data

(63) Continuation of application No. 14/345,464, filed as application No. PCT/SE2011/051352 on Nov. 10, 2011, now Pat. No. 9,635,451.

(51) Int. Cl.
*H04R 25/00* (2006.01)
*H04R 1/10* (2006.01)
(Continued)

(52) U.S. Cl.
CPC ..... *H04R 1/1058* (2013.01); *H04R 1/1008* (2013.01); *H04R 1/1033* (2013.01);
(Continued)

(58) Field of Classification Search
CPC .. H04R 1/1058; H04R 1/1008; H04R 1/1033; H04R 1/10; H04R 13/6271; H04R 27/00;
(Continued)

(56) References Cited

U.S. PATENT DOCUMENTS 6,181,796 B1 1/2001 Johnson
6,310,959 B1 10/2001 Alexander
(Continued)

FOREIGN PATENT DOCUMENTS

CN 2359848 Y 1/2000
CN 2859970 Y 1/2007
(Continued)

OTHER PUBLICATIONS

Urbanears (brochure), published by Zound Industries, 2009.
(Continued)

*Primary Examiner* — Andrew L Sniezek
(74) *Attorney, Agent, or Firm* — Knobbe Martens Olson & Bear LLP

(57) ABSTRACT

An audio accessory having headphones with at least one ear-cup and a connection cable for connecting the headphones to an audio device includes a separate connection cable with connection plugs at each of its two ends, whereby connections plugs of different types are provided at the respective ends of the connection cable. Separate sockets of the different types are further provided in the headphones for connection to a respective connection plug at an end of the connection cable. Alternative uses for the audio accessory as well as headphones and a connection cable are also provided.

23 Claims, 4 Drawing Sheets

(51) Int. Cl.

| | |
|---|---|
| *H01R 31/06* | (2006.01) |
| *H01R 27/00* | (2006.01) |
| *H01R 13/627* | (2006.01) |
| *H04R 5/033* | (2006.01) |

(52) U.S. Cl.
CPC ..... *H01R 13/6271* (2013.01); *H01R 27/00* (2013.01); *H01R 31/06* (2013.01); *H04R 1/10* (2013.01); *H04R 5/033* (2013.01); *H04R 2201/10* (2013.01); *H04R 2201/103* (2013.01); *H04R 2201/107* (2013.01); *H04R 2420/09* (2013.01)

(58) Field of Classification Search
CPC ..... H04R 31/06; H04R 2201/107; H04R 2420/09
See application file for complete search history.

(56) References Cited

U.S. PATENT DOCUMENTS

| | | | | |
|---|---|---|---|---|
| 6,466,681 | B1 | 10/2002 | Siska, Jr. | |
| 6,600,826 | B1 | 7/2003 | Xavier | |
| 7,907,721 | B1 | 3/2011 | Wurtz | |
| 9,635,451 | B2 * | 4/2017 | Petersen | H04R 1/1058 |
| 2002/0176330 | A1 | 11/2002 | Ramonowski et al. | |
| 2003/0022703 | A1 | 1/2003 | Reshefsky | |
| 2005/0002534 | A1 | 1/2005 | Aubauer et al. | |
| 2007/0025579 | A1 | 2/2007 | Kolton | |
| 2008/0152162 | A1 | 6/2008 | Bakalos et al. | |
| 2008/0166002 | A1 | 7/2008 | Amsel | |
| 2009/0010476 | A1 | 1/2009 | Pan | |
| 2009/0147982 | A1 | 6/2009 | Ashida et al. | |
| 2009/0180640 | A1 | 7/2009 | Ogawa | |
| 2009/0185707 | A1 | 7/2009 | Smith | |
| 2010/0111349 | A1 | 5/2010 | Devlas et al. | |
| 2010/0177924 | A1 | 7/2010 | Xu | |
| 2011/0111621 | A1 | 5/2011 | Wakrat et al. | |
| 2014/0348340 | A1 * | 11/2014 | Petersen | H04R 1/1008 381/74 |

FOREIGN PATENT DOCUMENTS

| | | | |
|---|---|---|---|
| CN | 101276963 | A | 10/2008 |
| CN | 101521320 | A | 9/2009 |
| EP | 2522155 | A1 | 11/2012 |
| JP | 10-155191 | | 6/1998 |
| TW | M342670 | U | 10/2008 |
| WO | WO 2011/082404 | A1 | 7/2011 |
| WO | WO2011082404 | A1 | 7/2011 |

OTHER PUBLICATIONS

Anonymous, Third Party Observation for application No. EP 20110728552, submitted Sep. 26, 2014 17:35.
Supplementary European Search Report for EP 11 87 5355 dated Apr. 29, 2015.
International Search Report for PCT/SE2011/051352 dated Aug. 9, 2012.
Anonymous, Third Party Observation for application No. EP 20110728552, submitted Nov. 18, 2013 18:48.
Anonymous, Third Party Observation for application No. EP 20110728552, submitted Nov. 18, 2013 19:17.
Filing Receipt from USPTO in U.S. Appl. No. 61/292,132, dated Jan. 15, 2010.
PCT Request Form in PCT/US2011/020057, submitted Jan. 3, 2011.
Office Action and Search Report in Chinese Application No. 201180074246.8, dated Aug. 26, 2016.

* cited by examiner

APP I

APP II

AUDIO ACCESSORY INCLUDING A HEADPHONE WITH SEPARATE SOCKETS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. For example, this application is a continuation of U.S. patent application Ser. No. 14/345,464, entitled AN AUDIO ACCESSORY INCLUDING A HEADPHONE WITH SEPARATE SOCKETS and filed Mar. 18, 2014, which is a U.S. National Phase Application of PCT International Application Number PCT/SE2011/051352, entitled AN AUDIO ACCESSORY INCLUDING A HEADPHONE WITH SEPARATE SOCKETS and filed on Nov. 10, 2011, designating the United States of America and published in the English language, the disclosure of each of which is incorporated by reference herein in its entirety for all purposes.

BACKGROUND

Field

The present invention generally concerns audio accessories and specifically relates to a headphone and connecting cable combination.

Description of the Related Art

Different types of music equipment/audio devices frequently use different types of interconnectable male and female connectors of different sizes that are commonly jointly referred to as headphone connectors. Examples thereof are mobile phones and various types of portable AV devices, such as mp3 players, that in most cases are equipped with a 3.5 mm size female connector that is commonly named a minijack or mini socket and that is intended for receiving a corresponding 3.5 mm size male connector that is commonly named a miniplug or minijack plug. On the contrary, professional audio equipment frequently uses a bigger 6.3 mm size female connector, namely a jack/socket also commonly named a ¼ inch jack, a full-size jack or a phono jack that is intended for receiving a corresponding 6.3 mm size male connector/plug. It is often regarded as a problem that such different connector types/sizes are used in various types of audio devices and equipment. It has the effect that users frequently switching between e.g. portable devices and non-portable equipment are required to employ an adapter when connecting accessories, such as headphones thereto. Such adapters are often small in size and are therefore easily misplaced or even lost.

SUMMARY

A general object of the present invention is to provide a solution to the discussed problems.

In particular it is an object of the invention to suggest an audio accessory providing improved alternative connection options.

In particular it is another object of the invention to suggest an improved headphone for use in such an audio accessory.

In particular it is a further object of the invention to suggest an improved connection cable for use in such an audio accessory.

These and other objects are met by the invention as defined by the accompanying claims.

The invention generally relates to an audio accessory that includes a headphone with ear-cup and connection cable for connecting the headphone to an audio device. In a basic configuration the accessory includes a separate connection cable having connection plugs at each of its two ends. Different types of connections plugs are provided at respective ends of the connection cable and separate sockets of said different types are provided in the headphone for connection to a respective connection plug of the connection cable.

In accordance with further aspects of the invention a headphone and a connection cable, respectively, are suggested for use in the inventive audio accessory. In basic configurations thereof they are provided with separate female and male connectors of different types for connection to a mating male and female connector, respectively.

The basic audio accessory presents the advantages of:

- allowing easy, instant connection of the accessory to various types of audio systems;
- alternative connection variants integrated in the accessory;
- dispensing with the need for separate adapters; and thereby
- avoiding the risk of misplacing or losing such separate adapter items.

Preferred further developments of the basic inventive idea as well as embodiments thereof are specified in the dependent subclaims.

Advantages offered by the present invention, in addition to those described above, will be readily appreciated upon reading the below detailed description of embodiments of the invention.

BRIEF DESCRIPTION OF THE DRAWINGS

The invention and its further objects and advantages will be best understood by reference to the following description taken together with the accompanying drawings, in which.

DETAILED DESCRIPTION

Figure 1A:
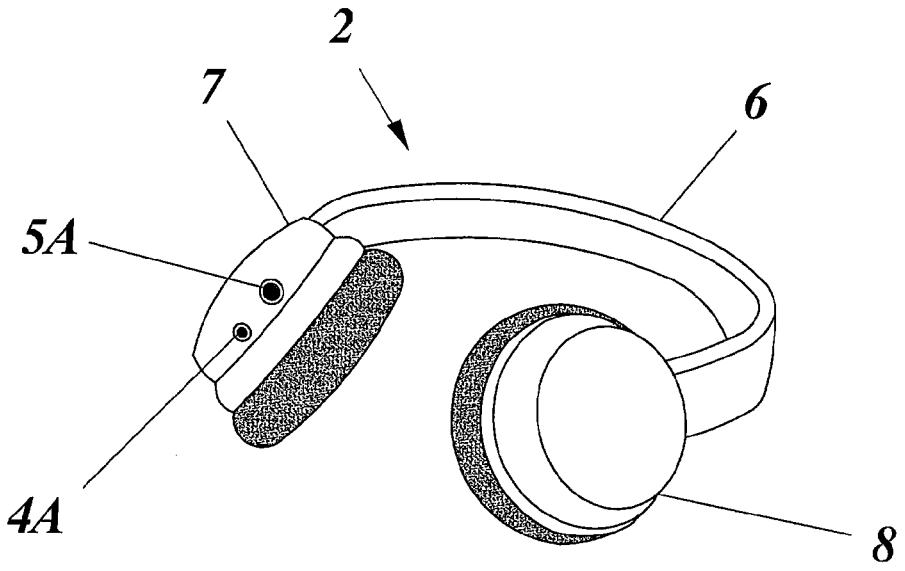
FIG. 1A is a schematical perspective view of a first embodiment of a headphone for use in the audio accessory of the invention.

The invention will be explained with reference to exemplifying embodiments of an audio accessory of the invention, including alternative uses thereof and alternative components included therein. These embodiments of the invention are described below and are illustrated in the accompanying drawing figures. They relate to an application of the inventive solution to an exemplary headphone and connection cable combination. It is emphasized that the illustrations are for the sole purpose of describing exemplary embodiments of the invention and are not intended to limit the invention to details or to any specific field of application thereof. The inventive solution may thus be used with and for other than the illustrated and described types of headphones and connection cables as well as audio devices and equipment that are all appropriate for such applications. Expressions such as user equipment, audio devices and audio equipment shall therefore throughout this specification include any type of equipment in connection with which audio accessories including a headphone and a connection cable may be employed. It shall be realized that the invention covers the incorporation of such application related features and any combination of features disclosed herein.

It is stated throughout this specification that the headphones have a separate connection cable and it shall be emphasized from the beginning that this shall mean that the connection cable is not stationary or fixed to the headphone but is readily connectable and disconnectable in relation thereto. Parts of the specification also refer in general to interconnectable male and female connectors of different types and or standards. For the purposes of the invention this may theoretically include interconnectable connectors of any type that may be used for connecting audio devices or audio equipment to an accessory, such as headphones. At the present time such male and female connectors are mainly connector plugs (often referred to also as jack plugs, phono plugs etc.) and connector jacks (often referred to also as sockets or jack sockets) of the TRS or TS type. Of such connectors a 3.5 mm size plug (often referred to as a standard minijack connector) and jack is the standard for music headphones and most other electronic devices/user equipment, such as mobile phones, whereas a 6.3 mm plug and jack is the standard for professional equipment, such as mixer tables or boards etc.

As was discussed in the introduction a common problem in association with connecting audio accessories to different types of audio devices as well as to audio equipment is the different types and/or standards of male and female connectors used therein. The invention attempts to overcome the disadvantages and problems encountered with the present commonly used solution of using separate small adapters that are often lost. The invention proposes a new approach for making this type of adapters superfluous in such applications. Specifically, the basic idea of the proposed solution is to provide an accessory including headphones and a separate connection cable having interconnectable connectors of two different types. This will provide the desired optional connection variants since the same cable may be used for connecting the headphones to most devices and equipment by simply turning the cable around.

Figure 1B:
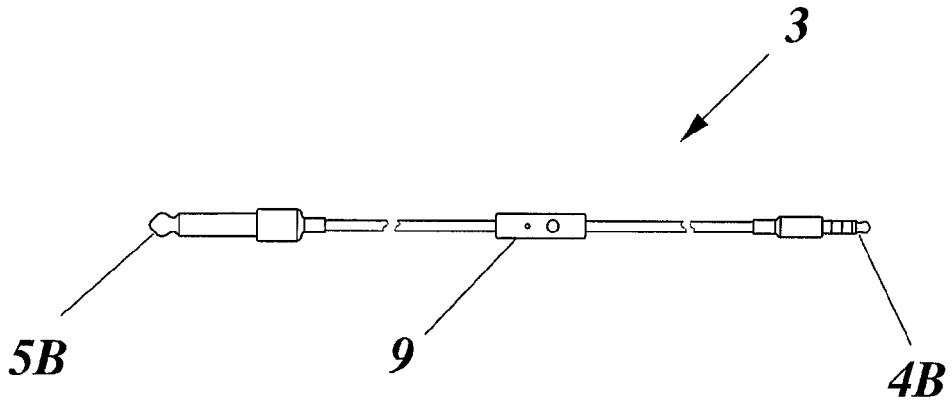
FIG. 1B is a schematical illustration of a connection cable for use in the audio accessory of the invention.

The invention will be explained below with reference to exemplifying schematical embodiments thereof that are illustrated in the accompanying drawing FIGS. 1-5. In FIGS. 1A-B is disclosed an exemplary embodiment of the inventive audio accessory to which the basic concept of the invention has been applied. In particular, FIGS. 1A-B schematically illustrate headphones 2 and a connection cable 3 being included in an audio accessory 1 (FIGS. 2 and 3) of the invention. The headphones 2 are of a basic type having two ear-cups 7, 8 supported by a headband 6. The connection cable 3 is a separate component used for connecting headphones 2 to user equipment 10, e.g. portable audio devices such as music players or mobile phones schematically indicated in FIG. 2, or alternatively to other audio equipment 11, such as a non-portable sound mixer board as schematically indicated in FIG. 3.

The connection cable illustrated in FIG. 1B has connection plugs 4B, 5B of mutually different types being provided at each of its two ends. In this embodiment one 4B of the connection plugs is a 3.5 mm (⅛ inch) size standard TRS or TS type male connector provided at one cable 3 end. The other connection plug 5B is a 6.3 mm (¼ inch) size standard TRS or TS type male connector provided at the opposite end of the cable 3. The headphones 2 illustrated in FIG. 1A have separate sockets 4A, 5A of said different types being provided in one 7 of the ear-cups for connection to a respective mating connection plug 4B and 5B, respectively, at an end of the connection cable 3. In this case one 4A of the sockets is thus a 3.5 mm (⅛ inch) size standard TRS or TS type female connector and the separate, slightly spaced other 5A socket is a 6.3 mm (¼ inch) size standard TRS or TS type female connector. In the illustrated embodiment the connection cable 3 is also equipped with a microphone 9 for allowing two-way communication, but it should be obvious that the inclusion of such a microphone is optional and does not form any actual part of the invention.

Figure 2:
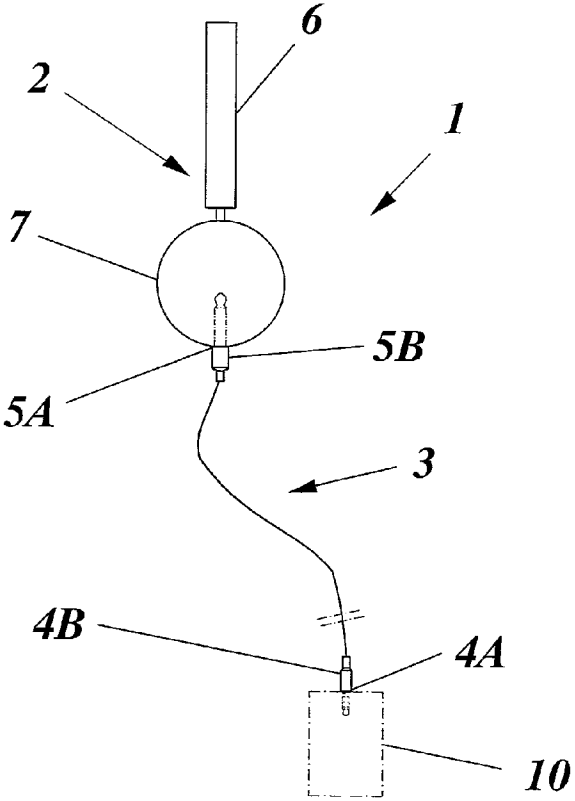
FIG. 2 is a schematical and partial view illustrating a first application I of the audio accessory of the invention.
Figure 3:
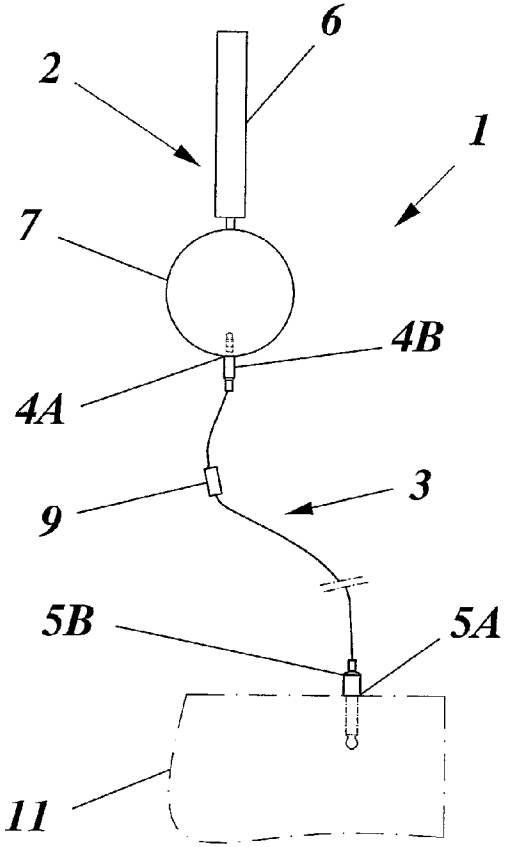
FIG. 3 is a schematical and partial view illustrating a second application II of the audio accessory of the invention.

With reference to FIGS. 2 and 3, the described embodiment of the audio accessory 1 of the invention may be used in two basic applications APP I and APP II. In the application APP I illustrated in FIG. 2 the connection cable 3 of FIG. 1B is connected with its 6.3 mm size connection plug 5B at one end of the connection cable 3 to a 6.3 mm size socket 5A of the headphones 2. The 3.5 mm size connection plug 4B at the other, opposite end of the connection cable 3 is connected to a mating 3.5 mm size socket 4A commonly found in predominantly portable user equipment 10, such as an mp3 music player or a mobile telephone for one- or two-way audio communication there between.

In an alternative application APP II of the inventive audio accessory 1 illustrated in FIG. 2, the cable 3 of FIG. 1B is simply turned around and connected with its 3.5 mm size connection plug 4B at one end of the connection cable 3 to the headphones 2. The 6.3 mm size connection plug 5B at the other end of the connection cable 3 is then connected to a mating 6,3 mm size socket 5A commonly found in predominantly stationary or non-portable audio devices 11, such as professional audio equipment. The switch between e.g. the described examples of applications may thus be performed without any small sized, easily misplaced or even lost adapters.

Figure 4:
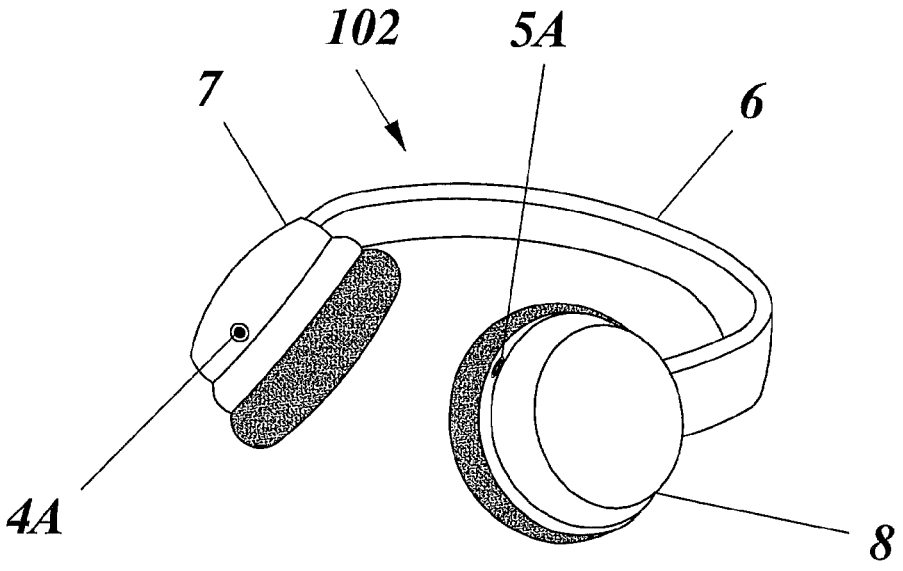
FIG. 4 is a schematical perspective view of a second embodiment of a headphone for use in the audio accessory of the invention.

In FIG. 4 is illustrated an alternative second embodiment of a pair of headphones 102 for inclusion in an audio accessory 1 of the invention, likewise in combination with a connection cable 3 as shown in FIG. 1B. Like before, the headphones 102 have two ear-cups 7, 8 supported by a headband 6 and two separate sockets 4A, 5A of said different types for connection to one each of the connection plugs 4B, 5B at the respective ends of the connection cable 3. However, in this embodiment is shown a variation of the first embodiment of FIG. 1A. Specifically, the separate sockets 4A, 5A are here provided in a separate ear-cup 7, 8, and specifically the left ear-cup of FIG. 4 is equipped with the 3.5 mm size socket 4A and the right ear-cup of FIG. 4 is equipped with the 6.3 mm size socket 5A.

Figure 5:
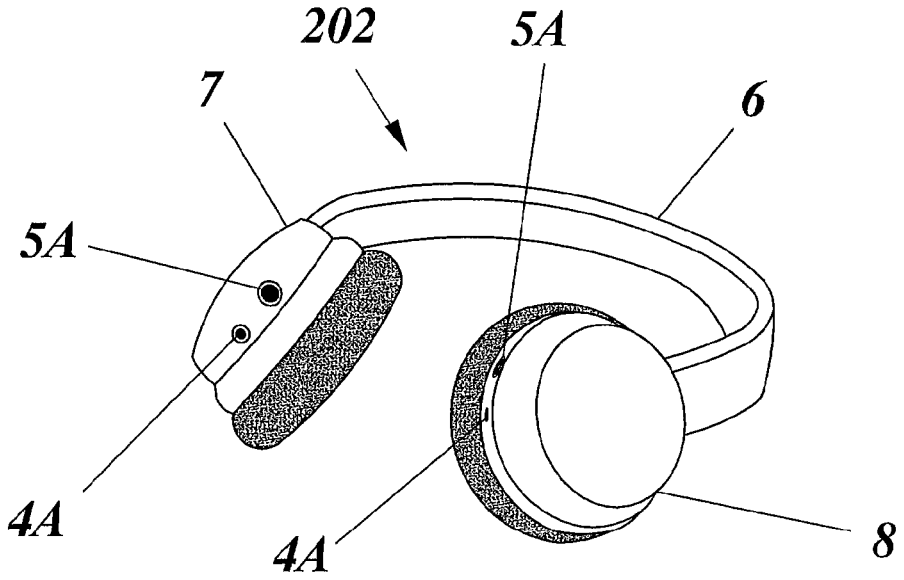
FIG. 5 is a schematical perspective view of a third embodiment of a headphone for use in the audio accessory of the invention.

In FIG. 5 is illustrated a further alternative third embodiment of a pair of headphones 202 for inclusion in an inventive audio accessory 1, likewise in combination with a connection cable 3 as shown in FIG. 1B. The headphones 202 likewise have two ear-cups 7, 8 supported by a headband 6 and separate sockets 4A, 5A of said different types for connection to one each of the connection plugs 4B, 5B at the respective ends of the connection cable 3. However, in this embodiment is shown a further variation of the first embodiment of FIG. 1A. Specifically, in this case the separate socket types 4A, 5A are paired in both ear-cups 7, 8, and specifically the left 7 as well as the right 8 ear-cup of FIG. 5 is equipped with both a 3.5 mm size socket 4A and a 6.3 mm size socket 5A.

Figure 6:
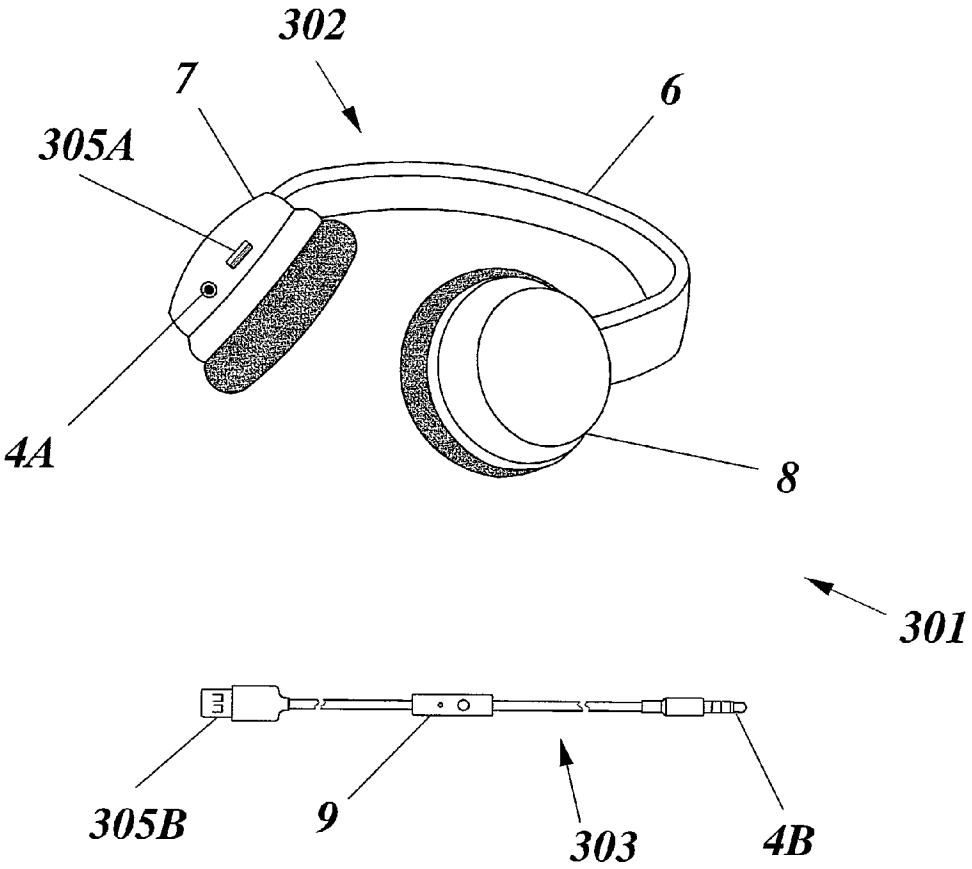
FIG. 6 is a schematical illustration of an alternative embodiment of an inventive audio accessory including variations of headphone and connection cable for use therein.

Finally, in FIG. 6 is illustrated an alternative embodiment of an audio accessory 301 of the invention. This variation is provided in order to exemplify the possible inclusion of other types of connectors in the headphones 302 and connection cable 303 of the audio accessory 301. In the given embodiment are used headphones 302 and connection cable 303 that are basically the same as those of the previously described ones, except for the use of an alternative type of connector. Specifically, the left ear-cup 7 of the headphone 302 of FIG. 6 has a female connector/socket 4A of the earlier described 3.5 mm size standard TRS or TS type, and one end of the connection cable 303 has a mating male connector/plug 4B of the 3.5 mm size standard TRS or TS type. However, here the ear-cup 7 also has a second female connector 305A that is an USB type socket. The opposite end of the connection cable 303 has a mating male connector 305B being an USB type plug for connection to the USB socket 305A of the headphones 302 or alternatively to mating USB sockets that are becoming increasingly common in user equipment. It will be clear that also this variation of the inventive audio accessory may be used in the previously described alternative modes or applications involving a simple turning around of the cable.

As stated above, the general object of the invention is to provide a solution that will make the presently commonly used separate small adapters superfluous in applications involving switching between different types of devices and equipment. This object is achieved by providing an accessory having the integrated adapter function to allow such switching without using separate additional adapters. For example, by providing the two different types of connectors in both the headphones and in the separate connection cable the switching between different types of devices may be performed by simply turning around the cable.

In alternative, but not specifically illustrated embodiments of the invention variations of the different illustrated parts of the inventive accessory may be employed without departing from the scope of the invention. An example of this is a use of the inventive solution to a headset type of accessory having only one ear-cup with two separate sockets being provided therein. Likewise, the connection cable of the accessory may or may not have the illustrated microphone. It shall also be emphasized that although the invention has been described and illustrated with specific reference to indicated applications thereof, the invention is in no way restricted to such applications. The basic principles of the invention may be used in association with other types of headphones and connection cables as well as audio devices/equipment and specifically also with other present and future types of connectors.

The invention has been described in connection with what is presently considered the most practical and preferred embodiments, but it is to be understood that the invention is not limited to the disclosed embodiments. The invention is therefore intended to cover various modifications and equivalent arrangements included within the spirit and scope of the appended claims

What is claimed is:

1. A headphone for listening to an audio output device, the headphone comprising:

a first ear-cup;

a first socket of a first socket type configured to receive therein a first type of audio cable plug on a first end of an audio cable that has a second type of audio cable plug on a second end, such that the second type of audio cable plug can connect to a first audio output connection type when the first type of audio cable plug is connected to the first socket; and a second socket of a second socket type configured to receive therein the second type of audio cable plug on the second end of the audio cable that has the first type of audio cable plug on the first end, such that the first type of audio cable plug can connect to a second audio output connection type when the second type of audio cable plug is connected to the second socket, wherein the first socket type is different from the second socket type.

2. The headphone of claim 1, wherein the first socket is included in the first ear-cup.

3. The headphone of claim 2, wherein the second socket is included in the first ear-cup.

4. The headphone of claim 1, wherein the first socket type is a 3.5 mm size standard tip-ring-sleeve (TRS) or tip-sleeve (TS) type.

5. The headphone of claim 4, wherein the second socket type is a 6.3 mm size standard tip-ring-sleeve (TRS) or tip-sleeve (TS) type.

6. The headphone of claim 4, wherein the second socket type is a standard universal serial bus (USB) type.

7. The headphone of claim 1, wherein the first socket type is a 6.3 mm size standard tip-ring-sleeve (TRS) or tip-sleeve (TS) type.

8. The headphone of claim 7, wherein the second socket type is a standard universal serial bus (USB) type.

9. The headphone of claim 1, further comprising:

a second ear-cup; and a headband coupling the first ear-cup with the second ear-cup, wherein the first socket is included in the first ear-cup and the second socket is included in the second ear-cup.

10. The headphone of claim 9, wherein the first socket type is a 3.5 mm size standard tip-ring-sleeve (TRS) or tip-sleeve (TS) type, and wherein the second socket type is either a 6.3 mm size standard tip-ring-sleeve (TRS) type, a 6.3 mm size standard tip-sleeve (TS) type, or a standard universal serial bus (USB) type.

11. The headphone of claim 1, wherein the audio output device comprises an user equipment, a portable audio device, a non-portable audio device, a stationary audio device, a music player, a mobile phone, a sound mixer board, an mp3 music player, or a professional audio equipment.

12. A headphone for listening to a first or a second audio output device, the first or second audio output device being one of a plurality of audio output devices each having different input types for connection to the headphone via a corresponding connection cable having a first type of audio cable plug on a first end and a second type of audio cable plug on a second end, the headphone comprising:

a first ear-cup;

a first socket of a first socket type configured to receive therein the first type of audio cable plug such that the second type of audio cable plug on the second end can connect to a first audio output connection type for connection to the first audio output device; and a second socket of a second socket type configured to receive therein the second type of audio cable plug such that the first type of audio cable plug on the first end can connect to a second audio output connection type for connection to the second audio output device, wherein the first socket type is different from the second socket type, such that the headphone can be connected to the first or second audio output device with the corresponding connection cable.

13. The headphone of claim 12, wherein the first socket is included in the first ear-cup.

14. The headphone of claim 13, wherein the second socket is included in the first ear-cup.

15. The headphone of claim 12, wherein the first socket type is a 3.5 mm size standard tip-ring-sleeve (TRS) or tip-sleeve (TS) type, and wherein the second socket type is either a 6.3 mm size standard tip-ring-sleeve (TRS) type, a 6.3 mm size standard tip-sleeve (TS) type, or a standard universal serial bus (USB) type.

16. The headphone of claim 12, further comprising:

a second ear-cup; and a headband coupling the first ear-cup with the second ear-cup, wherein the first socket is included in the first ear-cup and the second socket is included in the second ear-cup.

17. The headphone of claim 16, wherein the first socket type is a 3.5 mm size standard tip-ring-sleeve (TRS) or tip-sleeve (TS) type, and wherein the second socket type is either a 6.3 mm size standard tip-ring-sleeve (TRS) type, a 6.3 mm size standard tip-sleeve (TS) type, or a standard universal serial bus (USB) type.

18. The headphone of claim 12, wherein the first or second audio output device comprises an user equipment, a portable audio device, a non-portable audio device, a stationary audio device, a music player, a mobile phone, a sound mixer board, an mp3music player, or a professional audio equipment.

19. A method for listening to an audio output device, the method comprising:

providing a headphone for listening to the audio output device, wherein the headphone comprises:

a first ear-cup;

a first socket of a first socket type configured to receive therein a first type of audio cable plug on a first end of an audio cable that has a second type of audio cable plug on a second end, such that the second type of audio cable plug can connect to a first audio output connection type when the first type of audio cable plug is connected to the first socket; and a second socket of a second socket type configured to receive therein the second type of audio cable plug on the second end of the audio cable that has the first type of audio cable plug on the first end, such that the first type of audio cable plug can connect to a second audio output connection type when the second type of audio cable plug is connected to the second socket, wherein the first socket type is different from the second socket type.

20. The method of claim 19, wherein the first socket and the second socket are included in the first ear-cup.

21. The method of claim 19, wherein the headphone further comprises:

a second ear-cup; and a headband coupling the first ear-cup with the second ear-cup, wherein the first socket is included in the first ear-cup and the second socket is included in the second ear-cup.

22. The method of claim 19, wherein the first socket type is a 3.5 mm size standard tip-ring-sleeve (TRS) or tip-sleeve (TS) type, and wherein the second socket type is either a 6.3 mm size standard tip-ring-sleeve (TRS) type, a 6.3 mm size standard tip-sleeve (TS) type, or a standard universal serial bus (USB) type.

23. The method of claim 19, wherein the audio output device comprises an user equipment, a portable audio device, a non-portable audio device, a stationary audio device, a music player, a mobile phone, a sound mixer board, an mp3 music player, or a professional audio equipment.

* * * * *